US009433302B2

(12) United States Patent
Mojtabavi

(10) Patent No.: US 9,433,302 B2
(45) Date of Patent: Sep. 6, 2016

(54) MODULAR MATTRESS SYSTEM

(71) Applicant: Mehdi Mojtabavi, Vancouver, WA (US)

(72) Inventor: Mehdi Mojtabavi, Vancouver, WA (US)

( * ) Notice: Subject to any disclaimer, the term of this patent is extended or adjusted under 35 U.S.C. 154(b) by 0 days.

(21) Appl. No.: 14/648,215

(22) PCT Filed: Nov. 27, 2013

(86) PCT No.: PCT/US2013/072434
§ 371 (c)(1),
(2) Date: May 28, 2015

(87) PCT Pub. No.: WO2014/085724
PCT Pub. Date: Jun. 5, 2014

(65) Prior Publication Data

US 2015/0289670 A1 Oct. 15, 2015

Related U.S. Application Data

(60) Provisional application No. 61/730,811, filed on Nov. 28, 2012.

(51) Int. Cl.

| | |
|---|---|
| ***A47C 27/14*** | (2006.01) |
| ***A47C 27/00*** | (2006.01) |
| ***A47C 19/02*** | (2006.01) |
| ***A47G 9/02*** | (2006.01) |

(52) U.S. Cl.
CPC ..... *A47C 27/146* (2013.01); *A47C 19/025* (2013.01); *A47C 27/001* (2013.01); *A47C 27/148* (2013.01); *A47G 9/0246* (2013.01)

(58) Field of Classification Search
CPC ..... A47C 27/14
USPC ..... 5/722, 729–731, 740, 497
See application file for complete search history.

(56) References Cited

U.S. PATENT DOCUMENTS

| | | | | |
|---|---|---|---|---|
| 5,081,728 | A * | 1/1992 | Skinner | A47C 27/001 5/411 |
| 6,842,921 | B1 | 1/2005 | Tsiarkezos et al. | |
| 2013/0269114 | A1 | 10/2013 | Wu | |

FOREIGN PATENT DOCUMENTS

| | | | |
|---|---|---|---|
| DE | 4444447 | A1 | 6/1996 |
| FR | 2670103 | A1 | 6/1992 |
| RU | 67544 | U1 | 10/2007 |

OTHER PUBLICATIONS

"The Love Mattress: Modem Sleeping Solution for Couples", 2007 [retrieved on Apr. 11, 2016]. Retrieved from the Internet <URL: http://inventorspot.com/articles/love_mattress_modern_sleeping_so_9568>.

* cited by examiner

*Primary Examiner* — Fredrick Conley
(74) *Attorney, Agent, or Firm* — Stoel Rives LLP

(57) ABSTRACT

A modular mattress system (10) includes head, center, and foot sections (22, 20, 24) that include mattress modules (26, 40, 44), each having an interior (28,48, 58) and a width (30, 50, 60). At least one of the head and foot sections (22, 24) includes mattress modules (40, 44) of different sizes and smaller than the size of a mattress module (26) of the center section (22). Elongated N connection mechanisms (210) facilitate assembly of the mattress modules (26, 40, 44) to establish gaps (70) for an arm or foot of a person (12, 86) lying on the modular mattress system (10). The mattress modules (26, 40, 44) may include one or more layers, such as a core layer (140) and a softer layer (142). Different ones of the core layer (140) and softer layer (142) of the mattress modules (26, 40, 44) may be positioned at a body contact surface (34, 54, 64) of the modular mattress system (10).

18 Claims, 19 Drawing Sheets

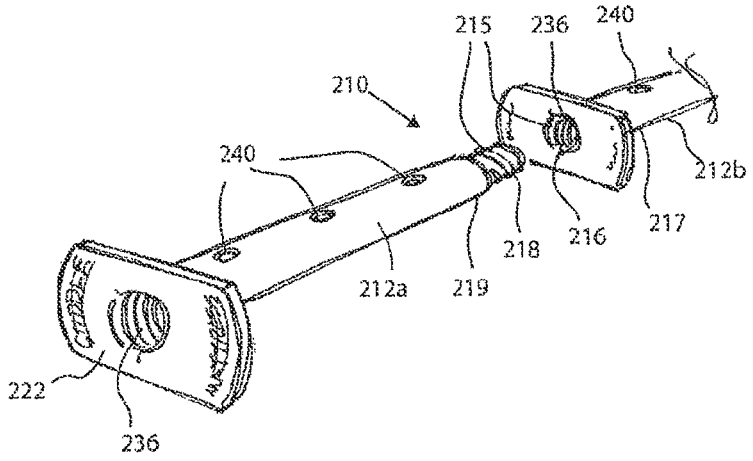
Fig. 22
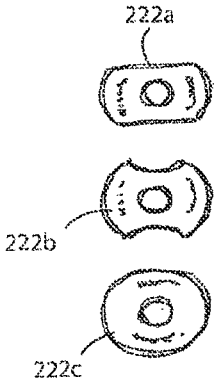
Fig. 25A
Fig. 25B
Fig. 25C
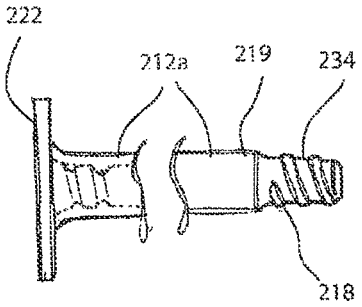
Fig. 24
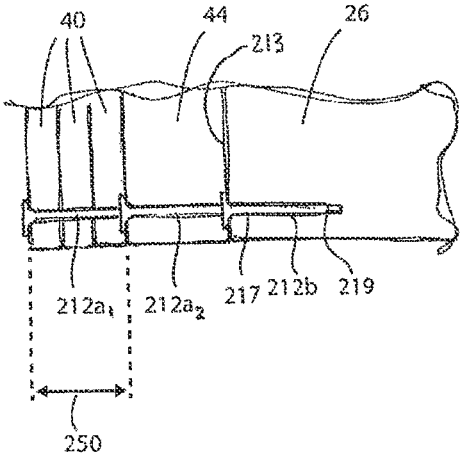
Fig. 23

Fig. 35A
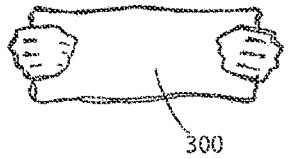
Fig. 35B
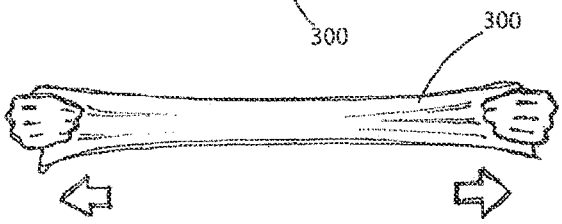
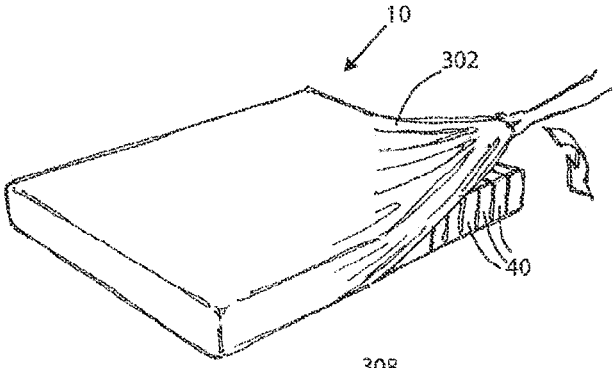
Fig. 36
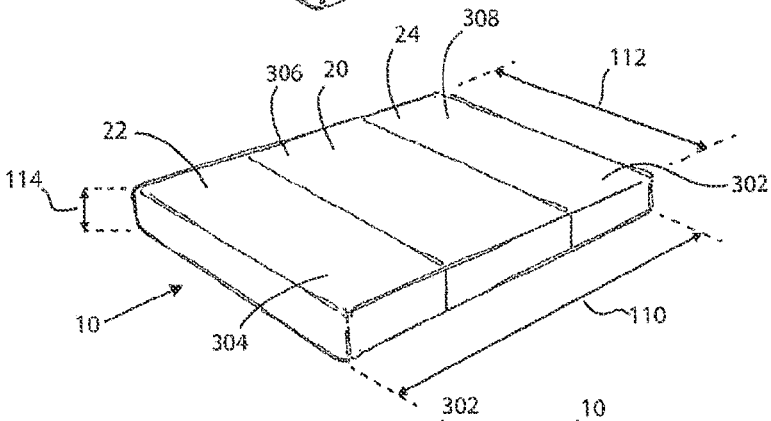
Fig. 37
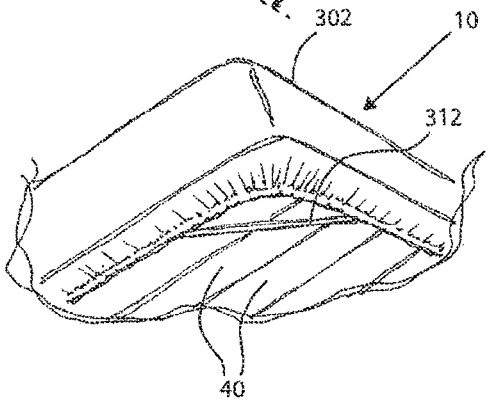
Fig. 38

MODULAR MATTRESS SYSTEM

RELATED APPLICATION

This application claims priority from U.S. Prov. Pat. Appl. No. 61/730,811, filed Nov. 28, 2012, which is herein incorporated by reference.

COPYRIGHT NOTICE

© 2013 Mehdi Mojtabavi. A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR §1.71(d).

TECHNICAL FIELD

This application relates to mattresses and, in particular, to a modular mattress system that facilitates multiple advantageous configurations of mattress modules.

BACKGROUND

Conventional mattresses have large flat, generally uniform surfaces. When a person sleeps on his or her side, the person's shoulder typically becomes compressed under the body or becomes bent forward or backward. Moreover, when sleeping on one's side, a person's backbone becomes significantly laterally curved. These various positions can be very uncomfortable and can cause serious pain and can even damage joints and nerves.

Conventional mattresses also present problems for couples trying to lie on a mattress while embracing with both sets of their arms. In addition to enduring the compressed arms, the embracing couple must also endure the discomfort in the shoulder or rib area of lying on the other person's arm.

SUMMARY

An aspect of this disclosure is, therefore, to provide a modular mattress system.

In some embodiments, a modular mattress system is formed by arrangement of multiple mattress sections that, when assembled, provide a body contact surface defined by multiple sectional body contact surface areas.

In some embodiments, a center mattress section is configured for positioning between a head mattress section and a foot mattress section, wherein the center mattress section has an interior, a width, and a central body contact surface area.

In some embodiments, each of the head and foot mattress sections includes multiple mattress modules, wherein one of the head and foot mattress sections includes mattress modules of different sizes, wherein each of the multiple mattress modules has an interior, a width, and a module body contact surface area that is smaller than the central body contact surface area of the center mattress section.

In some embodiments, multiple elongated connection mechanisms are sized to assemble the modular mattress system by extending in spaced-apart relationship through the interiors of, and in directions transverse to the widths of, the head, center, and foot mattress sections, wherein the connection mechanisms are configured to establish, in the assembled mattress system, gaps between adjacent ones of the multiple mattress modules and between the center mattress section and each of the head and foot mattress sections, wherein the gaps established in the head mattress section include gaps positioned in arm locations to receive a shoulder or an arm of a person lying on the body contact surface of the modular mattress system, and wherein the gaps established in the foot mattress section include gaps positioned at foot locations to receive a foot of a person lying on the body contact surface of the modular mattress system.

In some embodiments, multiple mattress modules, including first and second mattress modules, have an interior and a width, wherein each of the first and second modules includes a firmer material layer and one or more softer material layers, and wherein the firmer material layer is firmer than the softer material layer(s).

In some embodiments, an elongated connection mechanism is sized to assemble the modular mattress system by extending in spaced-apart relationship through the interiors of, and in directions transverse to the widths of, the first and second mattress modules, wherein the first mattress module is adjacent to the second mattress module, wherein the elongated connection mechanism permits the first and second mattress modules to be connected in multiple alternative body contact surface configurations with respect to each other, including first and second surface configurations, wherein the softer material layer of the first mattress module is adjacent to the softer material layer of the second mattress module in the first body contact surface configuration, and wherein the softer material layer of the first mattress module is adjacent to the firmer material layer of the second mattress module in the second body contact surface configuration.

In some embodiments, a method for packaging a mattress having a mattress length comprises forming multiple mattress modules, including first, second, and third mattress modules, wherein each of the multiple mattress modules has an interior and a width, wherein the first, second, and third mattress modules have different respective first, second, and third mattress module lengths in a direction transverse to the width, wherein the first mattress module length constitutes a unit module length that is shorter than the second and third mattress module lengths.

In some methods, the multiple mattress modules are stacked in multiple levels of mattress modules, wherein two of the levels include multiple mattress modules, wherein the multiple levels have level lengths, and wherein the level lengths are within two unit module lengths of each other.

Additional aspects and advantages will be apparent from the following detailed description of preferred embodiments, which proceeds with reference to the accompanying drawings.

BRIEF DESCRIPTION OF THE DRAWINGS

FIG. 22 is a fragmentary perspective view of other alternative rod segments of the module connection mechanism of the modular mattress system.

FIG. 23 is a fragmentary top plan view of the other alternative rod segments of the module connection mechanism.

FIG. 24 is a side elevation view of a portion of the other alternative rod segments of the module connection mechanism.

FIGS. 25A, 25B, and 25C are front views of three alternative end profiles of the module connection mechanism.

FIGS. 35A and 35B are front elevation views of a person's hands holding a piece of stretchable sheet fabric in, respectively, an unstretched condition and an exemplary stretched condition.

FIG. 36 is a perspective view of a fitted sheet of the stretchable fabric shown being deployed over an assembly of mattress modules of the modular mattress system.

FIG. 37 is a perspective view of an alternative sheet, including sections of stretchable sheet fabric spaced apart by a section of less stretchable fabric, deployed over an assembly of mattress modules of the modular mattress system.

FIG. 38 is a fragmentary perspective view of a corner of an underside of the assembly of mattress modules as covered by a sheet of stretchable sheet fabric, showing corner webbing and stretch lace at the perimeter of the sheet.

DETAILED DESCRIPTION OF PREFERRED EMBODIMENTS

Figure 1:
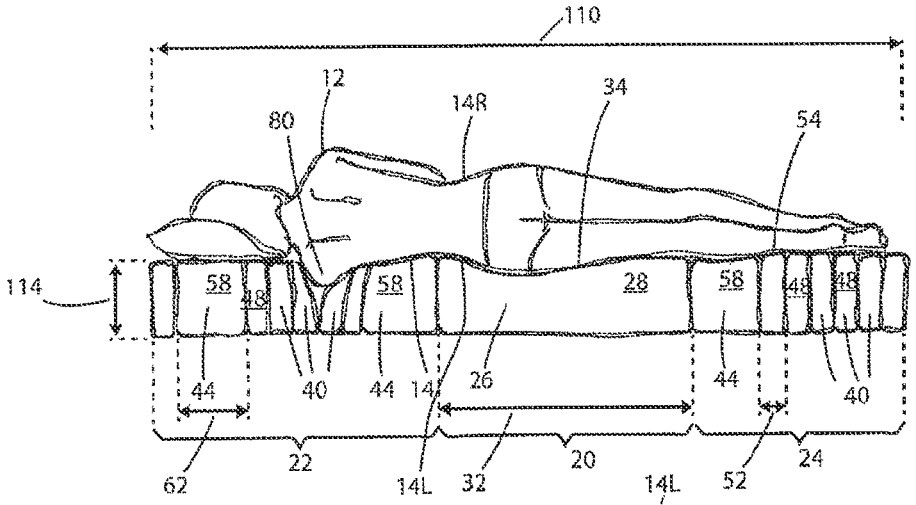
FIG. 1 is a side elevation view of an embodiment of a modular mattress system with a rear view of a person lying on her left side.
Figure 9:
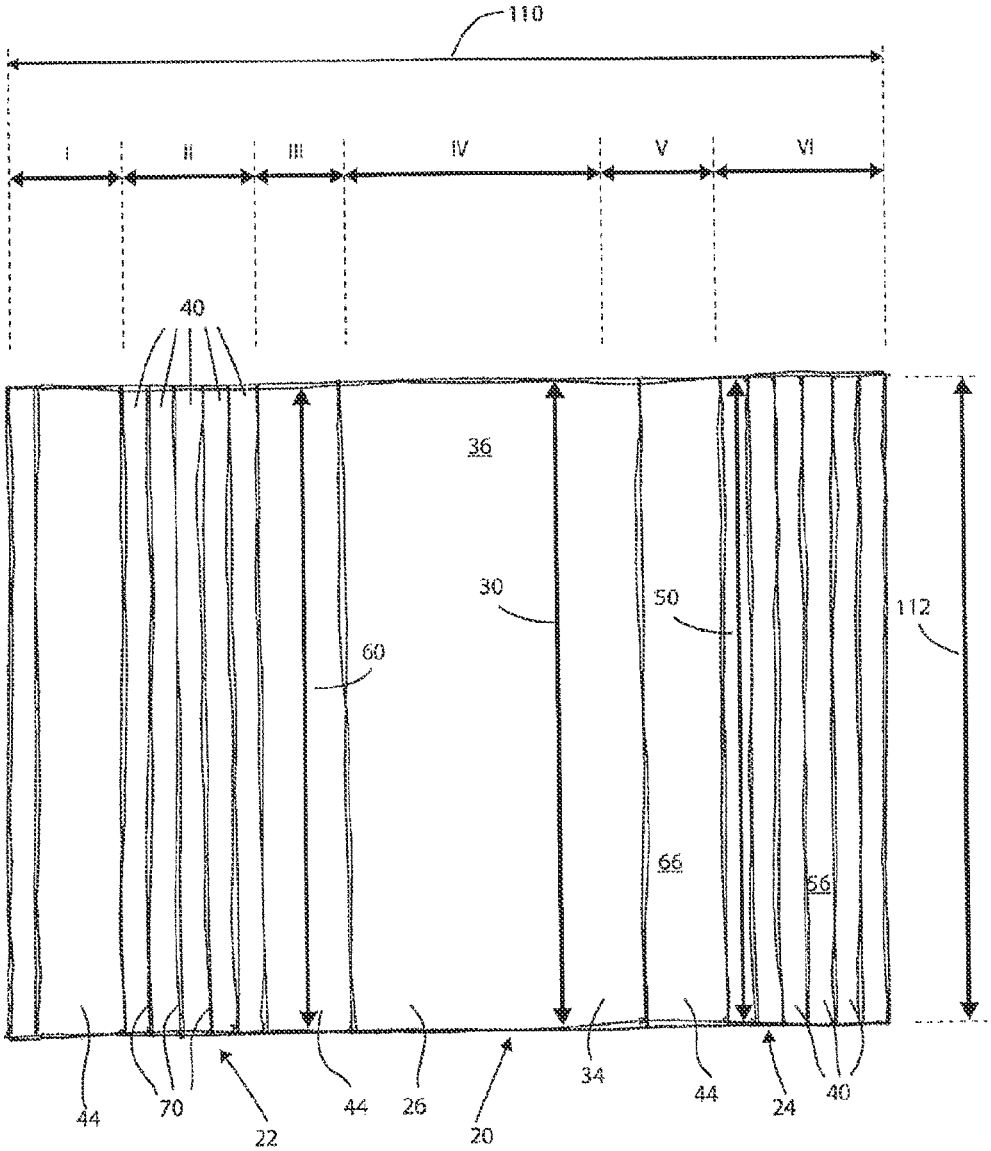
FIG. 9 is a top plan view of a body contact surface of an embodiment of the modular mattress system, showing an exemplary arrangement of modules within head, center, and foot mattress sections.

FIG. 1 is a side elevation view of an embodiment of a modular mattress system 10 with a rear view of a person 12 lying on her left side $\mathbf{14}_L$. With reference to FIG. 1, the modular mattress system 10 includes a center mattress section 20 configured for positioning between a head mattress section 22 and a foot mattress section 24. The center mattress section 20 includes a central mattress module 26 that has an interior 28, a width 30 (FIG. 9), a length 32, and a central body contact surface 34 that has a central body contact surface area 36 (FIG. 9).

In some embodiments, at least one of the head mattress section 22 and the foot mattress section 24 includes small-sized mattress modules 40 and medium-sized mattress modules 44. In some embodiments, the head mattress section 22 and the foot mattress section 24 each include small-sized mattress modules 40 and a medium-sized mattress module 44. The small-sized mattress modules 40 each have an interior 48, a width 50 (FIG. 9), a length 52, and a small module body contact surface 54 that has a small module body contact surface area 56 (FIG. 9). The medium-sized mattress modules 44 each have an interior 58, a width 60 (FIG. 9), a length 62, and a medium module body contact surface 64 that has a medium module body contact surface area 66 (FIG. 9).

The width 30, the width 50, and the width 60 have generally the same measurement. The small-sized mattress modules 40 are smaller than the medium-sized mattress modules 44, which are smaller than the central mattress module 26 of the center mattress section 20. Moreover, the length 52 of the small-sized mattress modules 40 is shorter than the length 62 of the medium-sized mattress modules 44, which is shorter than the length 32 of the central mattress module 26; and the small module body contact surface area 56 is smaller than the medium module body contact surface area 66, which is smaller than central body contact surface area 36.

When the modules 26, 40, and 44 of the various central, head, and foot sections 20, 22, and 24 of the modular mattress system 10 are assembled, gaps 70 (FIG. 2) are provided between adjacent ones of the various mattress modules 26, 40, and 44 and between the center mattress section 20 and each of the head mattress section 22 and the foot mattress section 24. The gaps 70 established in the head mattress section 22 include gaps 70 positioned in arm locations to receive a shoulder or an arm, such as demonstrated in FIGS. 1-5.

Figure 2:
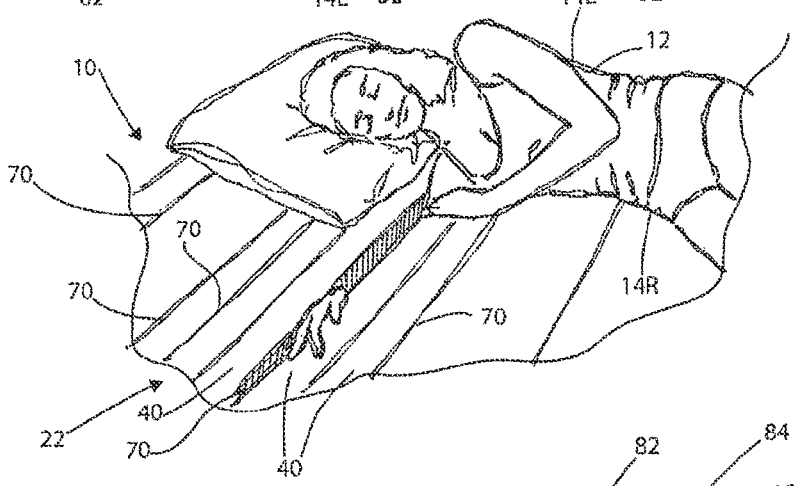
FIG. 2 is a fragmentary perspective view of an embodiment of the modular mattress system, showing a head mattress section with a front view of the person lying on her right side.
Figure 3:
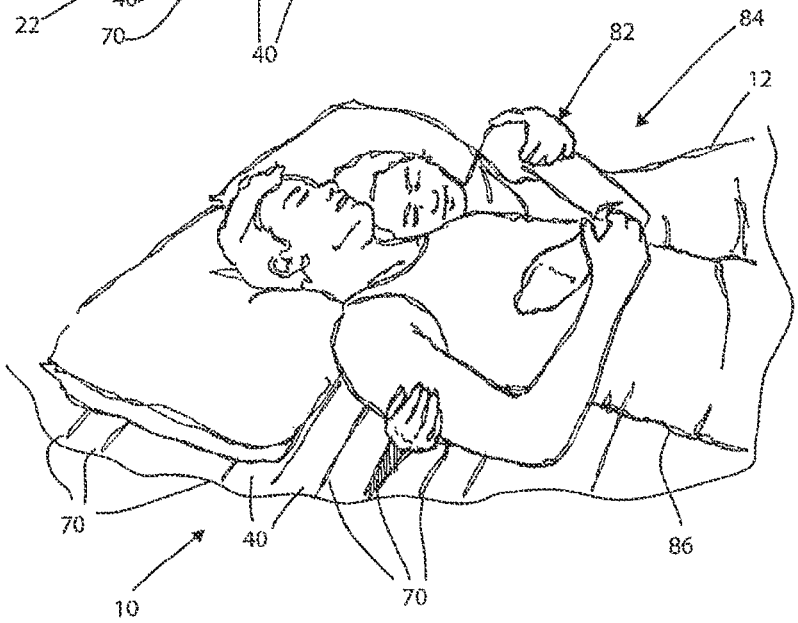
FIG. 3 is a fragmentary perspective view of an embodiment of the modular mattress system, showing the head mattress section with a pair of people snuggling thereupon.
Figure 4:
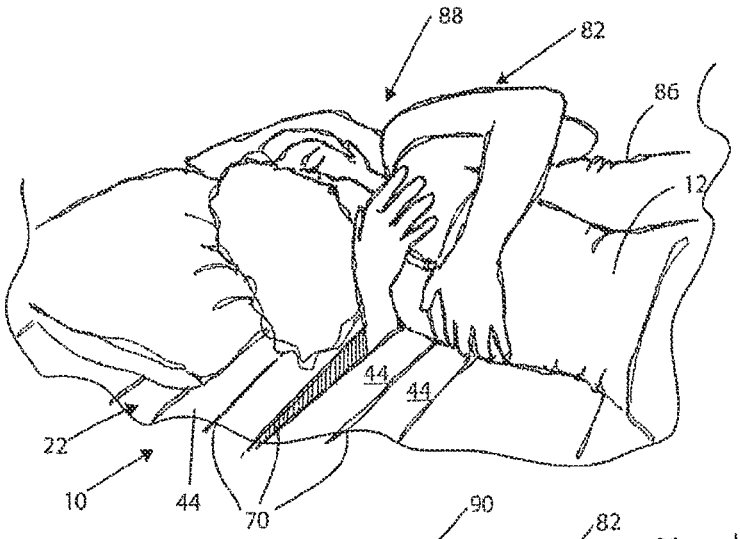
FIG. 4 is a fragmentary perspective view of an embodiment of the modular mattress system, showing the head mattress section with the pair of people hugging each other thereupon.
Figure 5:
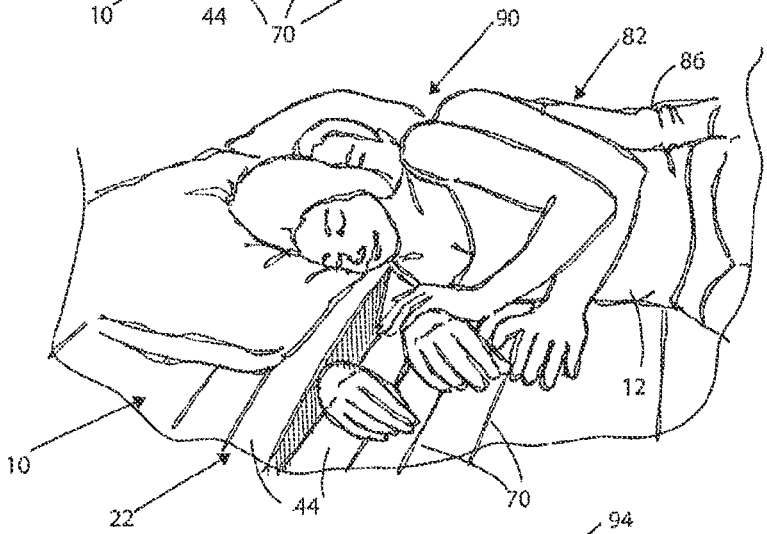
FIG. 5 is a fragmentary perspective view of an embodiment of the modular mattress system, showing the head mattress section with the pair of people spooning thereupon.

FIG. 1 shows that a left shoulder 80 of the person 12 can settle between adjacent ones of the mattress modules 40 of the head mattress section 22. FIG. 2 shows a front view of the person 12 lying on her right side $\mathbf{14}_R$ with her arm settled between adjacent mattress modules 40 of the head mattress section 22. FIG. 3 shows a pair of people 82 in a snuggling position 84 on the head mattress section 22 with the right arm of one person 12 under the upper back of the other person 86, wherein the underlying right arm is settled in the gap 70 between adjacent mattress modules 40. FIG. 4 shows the pair of people 82 in a hugging position 88 on the head mattress section 22 with the arms of both people wrapped around each others' shoulders, wherein the underlying arms are settled in gaps 70 between same or different pairs of adjacent mattress modules 40. FIG. 5 shows the pair of people 82 in a spooning position 90 on the head mattress section 22 with the right arm of one person 86 under the shoulder of the other person 12 who has her right arm settled in the gap 70 between adjacent mattress modules 40 of the head mattress section 22, wherein the underlying arms are settled in gaps 70 between the same or different pairs of adjacent mattress modules 40.

When a person 86 or 12 lies on his or her side, or assumes an embracing position, such as the snuggling position 84, the hugging position 88, or the spooning position 90, on a conventional mattress, the underlying shoulder and arm are compressed under a body or are bent forward or backward. These circumstances are very uncomfortable and can cause serious pain and can damage to joints and nerves. However, when a person is side lying or assumes the snuggling position 84, the hugging position 88, or the spooning position 90 on a modular mattress system 10, the arm and shoulder can be placed in a gap 70 between the mattress modules 40 (or between mattress modules 40 and 44) to minimize the pressure on the arm and shoulder.

Figure 6:
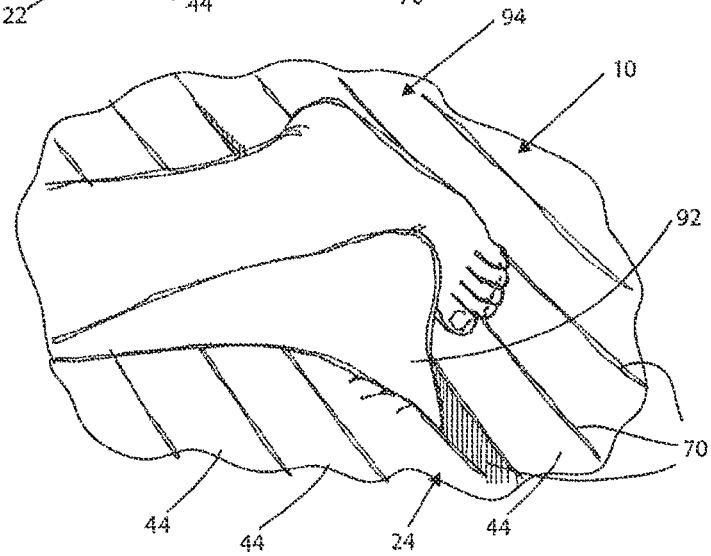
FIG. 6 is a fragmentary perspective view of an embodiment of the modular mattress system, showing a foot mattress section with an advantageous position for a foot when the person is lying on his or her stomach.

The gaps 70 established in the foot mattress section 24 include gaps 70 positioned in foot to receive a foot, such as demonstrated in FIG. 6. FIG. 6 shows a foot 92 settled between adjacent mattress modules 40 of the foot mattress section 24 with an advantageous foot position 94 for when the person 86 or 12 is lying on his or her stomach.

Figure 7:
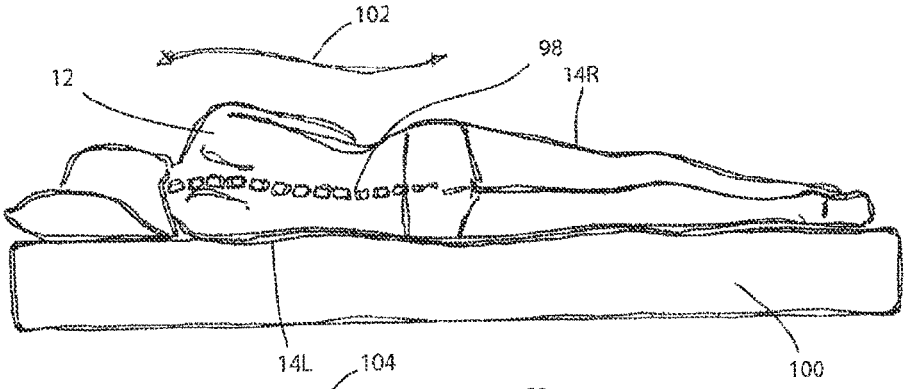
Fig. 7 (Prior Art)
FIG. 7 is a side elevation view of a conventional mattress, showing significant lateral spinal curvature of the person lying on her left side.
Figure 8:
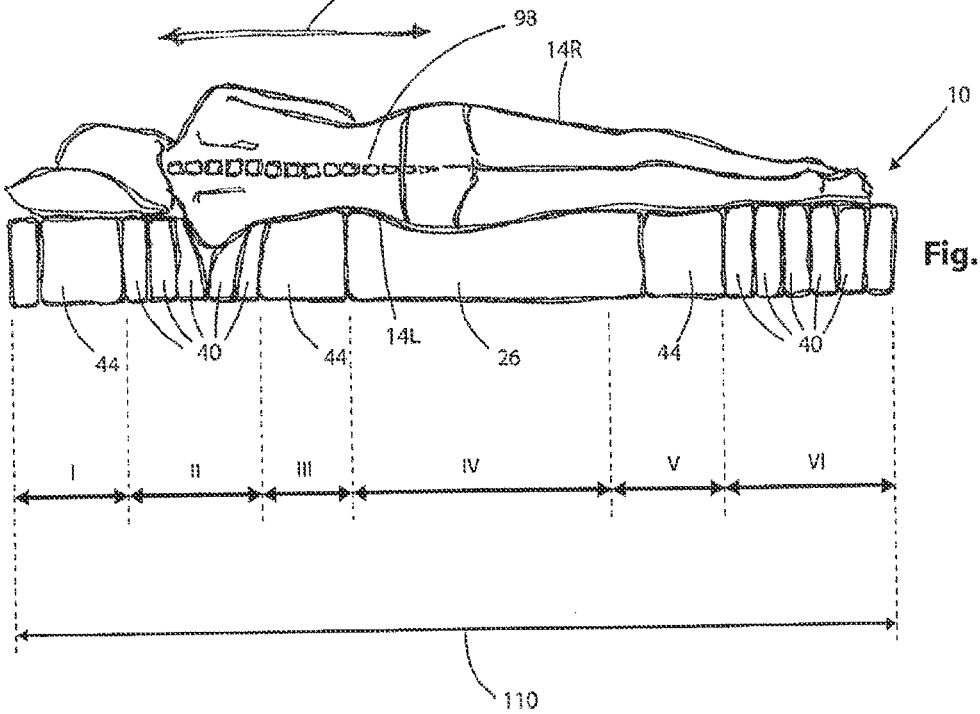
FIG. 8 is a side elevation view of an embodiment of the modular mattress system, showing minimal lateral spinal curvature of the person lying on her left side, and showing an exemplary arrangement of modules within head, center, and foot mattress sections.

FIG. 7 shows a spinal column 98 of the person 12 who is lying on her left side on a conventional mattress 100. With reference to FIG. 7, the spinal column 98 of the person 12 side lying on the conventional mattress 100 exhibits significant lateral spinal curvature, as more readily presented by a curved line 102. However, FIG. 8 shows a spinal column 98 of the person 12 who is side lying on the modular mattress system 10. With reference to FIG. 8, the spinal column 98 of the person 12 side lying on the modular mattress system 10 exhibits a relatively straight spine without significant lateral spinal curvature as more readily presented by a straight line 104. The gaps 70 and the selective arrangement of the various mattress modules 26, 40, and 44 within the head mattress section 22, the center mattress section 20, and the foot mattress section 24 reduce compression and provide support as suitable for six main zones of a human body.

FIGS. 8 and 9 are respective side elevation and top plan views that demonstrate an exemplary arrangement of various mattress modules 26, 40, and 44 within the head mattress section 22, the center mattress section 20, and the foot mattress section 24 that correlates with, and accommodates, six main zones of the human body. With reference to FIGS. 8 and 9, the head mattress section 22 generally includes a head and neck zone I, a shoulder and upper back zone II, and a lumbar zone III. The center mattress section 22 generally includes a pelvic zone IV. The foot mattress section 24 generally includes a knee and lower leg zone V and a foot and ankle zone VI. In some embodiments, the knee and lower leg zone V overlays a portion of the central mattress module 26.

In general, a person's arm, shoulder, and foot are three body parts that predominantly benefit from access to the gaps 70 between the mattress modules 40 in some sleeping or embracing positions. Thus, in some embodiments, multiple small-sized mattress modules 40 are placed in zones II and VI to provide multiple options to insert one or more of the arm, shoulder, and foot. The number and location of the small-sized mattress modules 40 has been optimized to cover more than 95% of the different sizes of the human body. In some embodiments, zones II and VI independently have fewer than eight small-sized mattress modules 40. In some embodiments, zones II and VI independently have three to seven small-sized mattress modules 40. In some embodiments, zones II and VI independently have four to six small-sized mattress modules 40. Moreover, zones II and VI need not have the same number of small-sized mattress modules 40.

For convenience and simplicity of manufacturing, the multiple small-sized mattress modules 40 all have the same length 52, which can be considered to be a unit length. However, in some embodiments, some of the multiple small-sized mattress modules 40 have different lengths 52. In some embodiments, the unit length is about 1/32 of a standard mattress length or 1/32 of the length 110 of the mattress module system 10. The mattress module system 10 may have an exemplary length 110 of 75" to 84" (190 cm to 215 cm), so an exemplary unit length may be from 2.3" to 2.6" (5.5 cm to 7 cm). If fewer small-sized mattress modules 40 (or fewer or shorter medium-sized modules 44 are used), for example, then the exemplary unit length may be longer. An alternative exemplary unit length may be from 3" to 5" (7 cm to 13 cm).

Mattress widths have numerous standard sizes, so the mattress module system 10 may have a width 112 (and may have module widths 30, 50, and 60), such as 36" (91 cm), 54" (137 cm), 60" (152 cm), 72" (183 cm), and 76" (193 cm) or other measurement. Similarly, mattress depths have numerous standard sizes, so the mattress module system 10 (and/or its modules) may have a depth 114, such as from 9" to 10" (23 cm to 26 cm) or 15" to 16" (38 cm to 41 cm) or other measurement.

In areas of the head mattress section 22 and the foot mattress section 24 where shoulders, arms, or feet are less likely to be positioned, the medium-sized modules 44 can be deployed. Using the medium-sized modules 44 where small-sized mattress modules 40 are not necessary has several advantages. The medium-sized modules 44 can provide more rigidity for the assembled modular mattress system 10, as well as facilitate moving and shipping. A fewer total number of mattress modules to manufacture also reduces cost.

Exemplary locations for the medium-sized modules 44 are in zone I to support the head and neck, zone III to support the lumbar region of the body, and zone V to support the knee and lower leg. In such an example, the head mattress section 22 would include two medium-sized modules 44, and the foot mattress section 24 would include one medium-sized module 44. However, in some embodiments, either the head mattress section 22 or the foot mattress section 24 could have one, two, or more medium-sized modules 44.

For convenience and simplicity of manufacturing, the medium-sized mattress modules 44 all have the same length 62. However, in some embodiments, some of the medium-sized mattress modules 44 have different lengths 62. In some exemplary embodiments, the length 62 is a factor of the unit length. For example, the length 62 may be from two to four times the unit length. In some preferred embodiments, the length 62 is three times the unit length, and more specifically three times the length 52.

The center mattress section 20 may include a single large-sized mattress module 26 that occupies the pelvic zone IV and part of the knee and lower leg zone V. For convenience and simplicity of manufacturing and packaging, the length 26 of the large-sized mattress module 26 is a factor of the unit length. For example, the length 26 may be eight to thirteen times the unit length. In some preferred embodiments, the length 26 is eleven times the unit length, and more specifically eleven times the length 52.

Although the assembled arrangement as shown in FIGS. 8 and 9 and described herein is optimal for the majority of the population, the arrangement can be customized to provide gaps 70 in locations as desired. The arrangement can also be customized to provide larger support areas by the medium-sized mattress modules 44 and the large-sized mattress module 26 in locations as desired. Moreover, the module sizes and the number of given modules can be adjusted to suit particular body types in specific demographic regions. It will also be appreciated that the mattress module system 10 may have more than four sizes of mattress modules.

Figure 10:
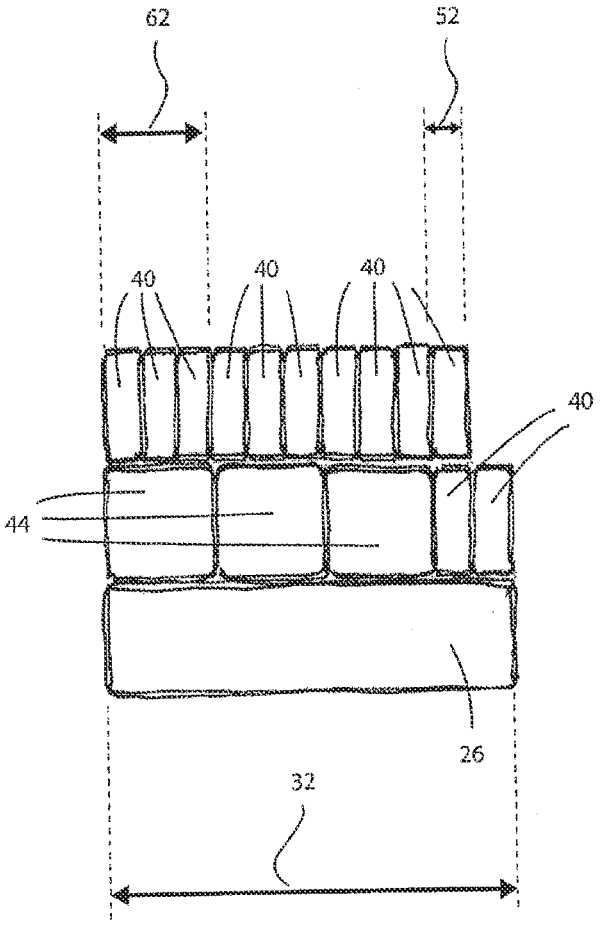
FIG. 10 is side elevation view of the modular mattress system in an exemplary multiple module layer configuration for packaging.

FIG. 10 is a side view of the modular mattress system 10 in an exemplary multiple module layer configuration for packaging. When the small-sized mattress module 40 has a length 52 that constitutes a unit module length, and the medium-sized module 44 has a length 62 that is a factor of the unit length, and the large-sized module 26 has a length 32 that is a factor of the unit length, stacking and packaging of the mattress modular system 10 becomes simplified. For example, the small-, medium-, and large-sized mattress modules can be stacked in multiple module levels, such that at least two of the module levels include multiple mattress modules, wherein the multiple module levels have level lengths, and wherein the level lengths are within two unit module lengths of each other. One such exemplary stacking configuration includes a first level that has a large-sized mattress module 26 having a length 32 of eleven unit module lengths 52, a second level that has three medium-sized mattress modules 44 each having a three unit module length 62 and two small-sized mattress modules 40 each having a unit module length 52, and a third level that has ten small-sized mattress modules 40 each having a unit module length 52. In this particular stacking configuration, the level lengths are within one unit module length of each other. Moreover, a different combination of modules on the module levels can be used to provide three levels having level lengths of eleven, eleven, and ten unit module lengths. It will also be appreciated that the mattress modules may be stacked for packaging into two, four, or more levels, as well as three levels. Each level of mattress modules (or a subset of mattress modules) may be individually wrapped in plastic and compressed and/or vacuum packed to reduce the size of the levels for shipping. However, other compression and packaging techniques could be employed.

Figure 11:
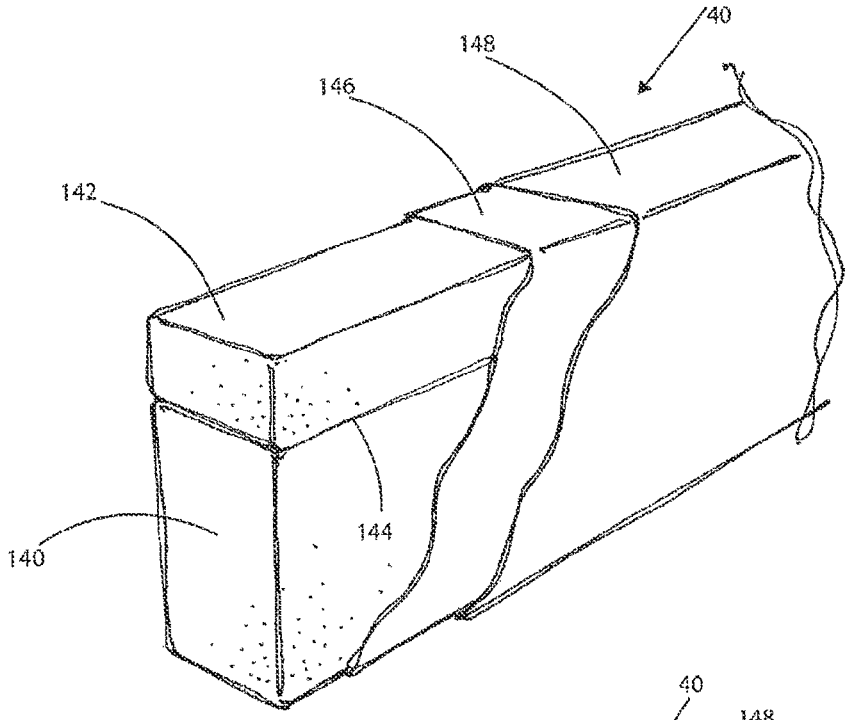
FIG. 11 is a fragmentary perspective view of a partly peeled-apart portion of a mattress module of the modular mattress system, showing structural layers and covering overlays of an exemplary embodiment of the mattress module.

FIG. 11 shows a partly peeled-apart portion of a small-sized mattress module 40. The interiors 48, 58, and 28 of the small-, medium-, and large-sized mattress modules 44, 40, and 26 can be made of a single material or of multiple material layers, such as including a firmer material layer 140 and a softer material layer 142, wherein the firmer material layer 140 is firmer than the softer material layer 142. These structural layers may, however, form any combination of soft, medium, firm, and extra firm layers of any type of open-cell breathable foam, for example. In some embodiments, the firmer material layer is a base or core material layer.

Exemplary combinations include: a core material layer 140 of a firm polyurethane foam and a softer material layer 142 of a soft polyurethane foam; a core material layer 140 of a firm polyurethane foam and a softer material layer 142 of a soft polyurethane memory foam; or a core material layer 140 of a firm latex foam and a softer material layer 142 of a soft latex foam; or any cross combination thereof. The core material layer 140 and the softer material layer 142 can be bonded together with glue 144 or any type of adhesive. The small-, medium-, and large-sized mattress modules 44, 40, and 26 need not be made of the same materials combination of the core material layer 140 and the softer material layer 142.

FIG. 11 also shows an exemplary internal covering overlay 146 and an exemplary external covering overlay 148. In some embodiments, the internal covering overlay 146 may be made of muslin or similar lining fabric to isolate the foam structural layers from the external covering overlay 148. The presence of the internal covering overlay 146 makes it easier to put on the external covering overlay 148. The external covering overlay 148 may be made of a smooth and/or slippery fabric like satin to facilitate the slide of arm or a shoulder in between the mattress modules 40. The external covering overlay 148 may include a fastening mechanism such as a zipper or a Velcro™ fastener so that consumers can remove and wash the external covering overlay 148 as needed.

Figure 12:
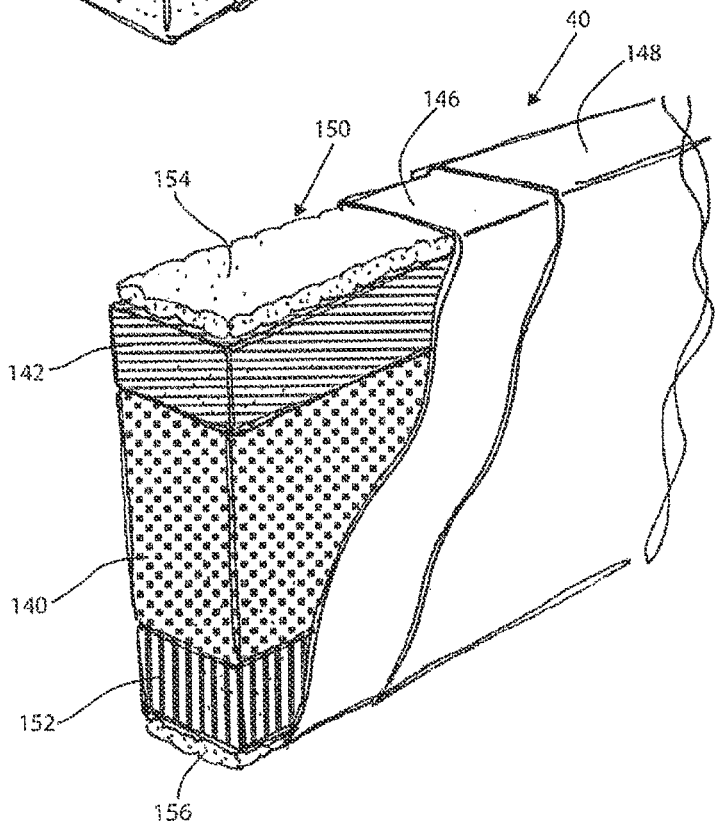
FIG. 12 is a fragmentary perspective view of structural layers and covering skins of an alternative partly peeled apart mattress module.
Figure 12A:
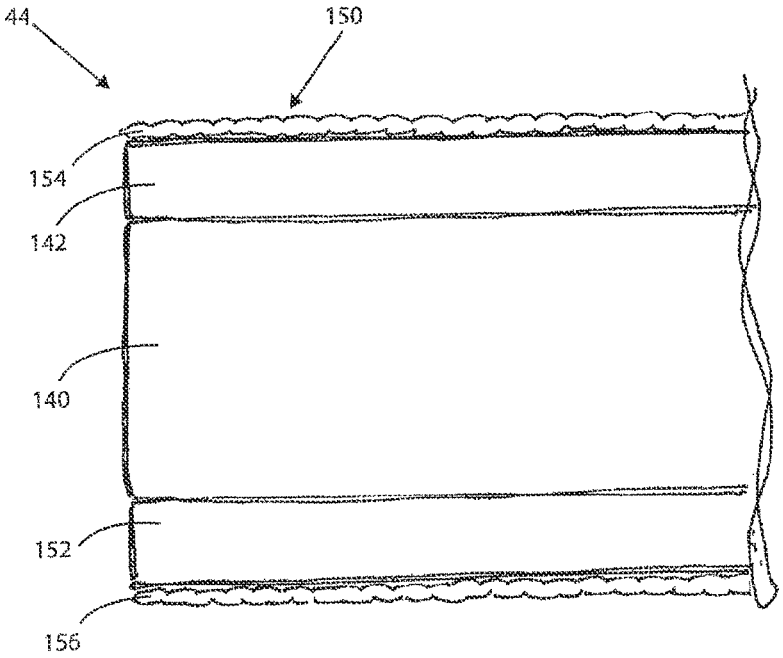
FIG. 12A is fragmentary side elevation view of structural layers an alternative mattress module.

FIG. 12 demonstrates an alternative exemplary structural configuration 150 of layers of the interiors 48, 58, and 28 of the small-, medium-, and large-sized mattress modules 44, 40, and 26. In addition to the core material layer 140 and the softer material layer 142, the structural configuration 150 includes a medium firmness layer 152 positioned to sandwich the core material layer 140 between the softer material layer 142 and the medium firmness layer 152. In some embodiments, the softer material layer 142 and the medium firmness layer 152 are themselves covered with respective pillow top (or other type) layers 154 and 156. The advantage of such a multilayer structural configuration 150 is that a consumer could choose to have either the softer material layer 142 or the medium firmness layer 152 closest to the body contact surfaces 34, 54, and 64.

Figure 13:
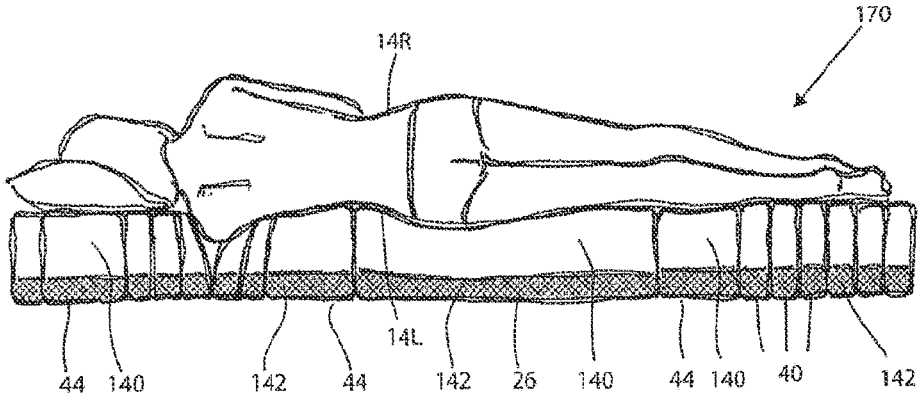
FIG. 13 is a side elevation view of a portion of an embodiment of the modular mattress system (with a rear view of a person lying on her left side), showing an exemplary surface configuration of the body contact surface.
Figure 14:
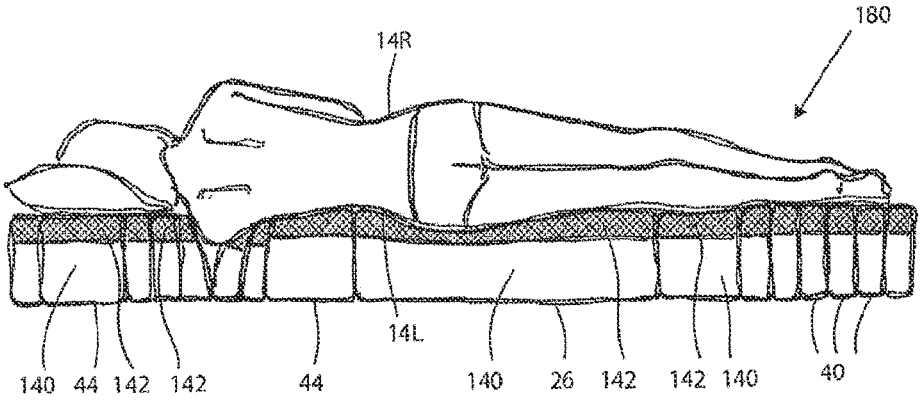
FIG. 14 is a side elevation view of a portion of an embodiment of the modular mattress system (with a rear view of a person lying on her left side), showing an alternative surface configuration of the body contact surface.
Figure 15:
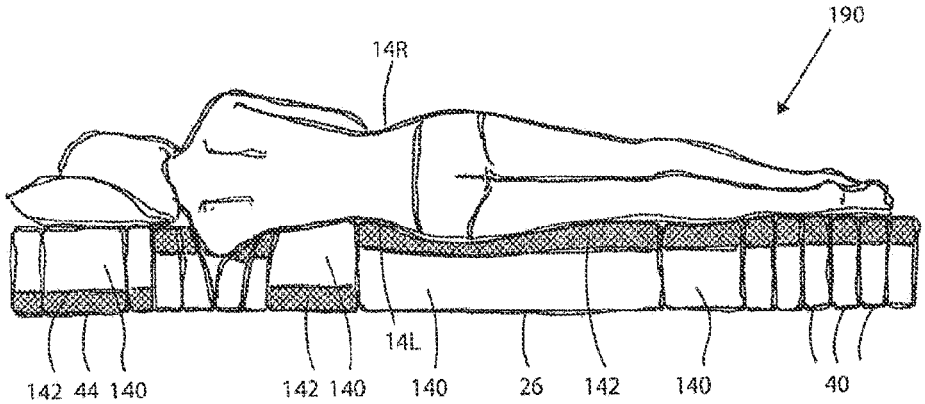
FIG. 15 is a side elevation view of a portion of an embodiment of the modular mattress system (with a rear view of a person lying on her left side), showing another alternative exemplary surface configuration of the body contact surface.

FIGS. 13, 14, and 15 show three exemplary alternative body contact surface configurations of the assembled modular mattress system 10. With reference to FIGS. 13, 14, and 15, a hard body contact surface configuration 170 shown in FIG. 13 includes the small-, medium-, and large-sized mattress modules 44, 40, and 26 all configured to have their core material layers 140 serve as the closest structural layer to the body contact surfaces 54, 64, and 34. A soft body contact surface configuration 180 shown in FIG. 14 includes the small-, medium-, and large-sized mattress modules 44, 40, and 26 all configured to have their softer material layers 142 serve as the closest structural layer to the body contact surfaces 54, 64, and 34. In the hard body contact surface configuration 170 and in the soft body contact surface configuration 180, the softer material layer 142 of each mattress module is adjacent to the softer material layer 142 of the neighboring mattress module. The hard body contact surface configuration 170 and the soft body contact surface configuration 180 permit a customer to choose between uniform surface firmness of two firmness levels.

A mixed body contact surface configuration 190 shown in FIG. 15 includes the small-, medium-, and large-sized mattress modules 44, 40, and 26 with some configured to have their core material layers 140 serve as the closest structural layer to the body contact surfaces 54, 64, and 34 and with some configured to have their softer material layers 142 serve as the closest structural layer to the body contact surfaces 54, 64, and 34. In the mixed body contact surface configuration 190, at least two neighboring mattress modules are configured so that the softer material layer 142 of a first mattress module is adjacent to the core material layer 140 of a second neighboring mattress module. The mixed body contact surface configuration 190 permits a customer to select the firmness orientation of each individual mattress module in each zone of each mattress section to provide a highly customized feel of the modular mattress system 10.

Figure 16:
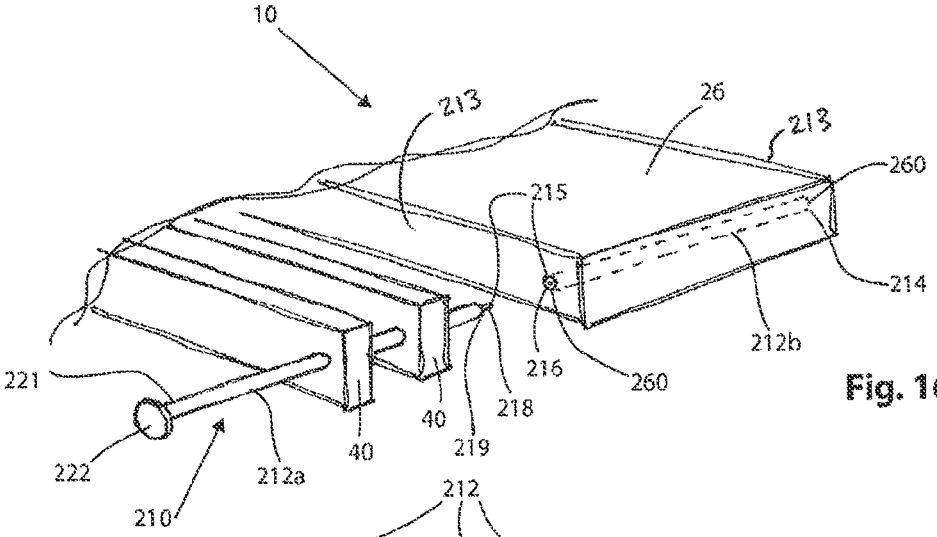
FIG. 16 is a fragmentary, exploded perspective view of exemplary rod segments of a module connection mechanism of the modular mattress system.
Figure 16A:
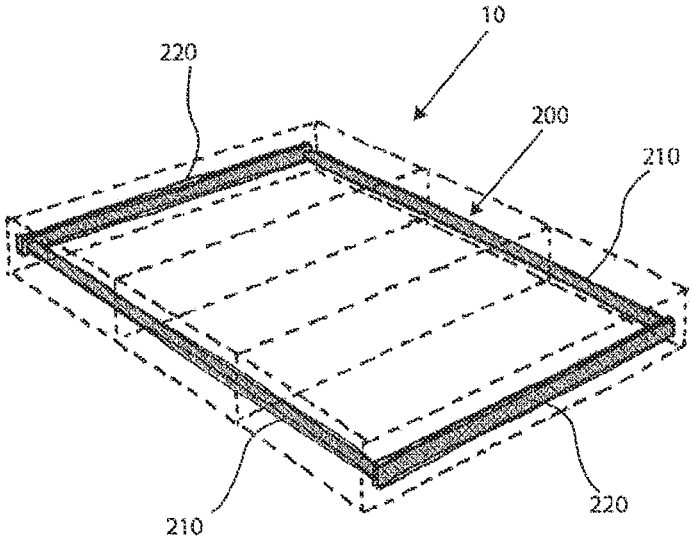
FIG. 16A is a perspective view showing an exemplary module frame of the modular mattress system.

FIG. 16A shows an exemplary module frame 200 of the modular mattress system 10. The module frame 200 includes multiple elongated connection mechanisms 210 sized to assemble the modular mattress system 10 by extending in spaced-apart relationship through the interiors 48, 58, and 28 of the small-, medium-, and large-sized mattress modules 44, 40, and 26, and in directions transverse to the width 112 of the head, center, and foot mattress sections 22, 20, and 24. The connection mechanisms 210 are configured to establish, in the assembled modular mattress system 10, the gaps 70 between adjacent ones of the multiple mattress modules 44, 40, and 26 and between the center mattress section 20 and each of the head and foot mattress sections 22 and 24. FIG. 16A also shows multiple braces 220 that extend in a direction parallel to the width 112 and transverse to the multiple elongated connection mechanisms 210 such that the braces 220 are connected to the multiple elongated connection mechanisms 210.

Figure 17:
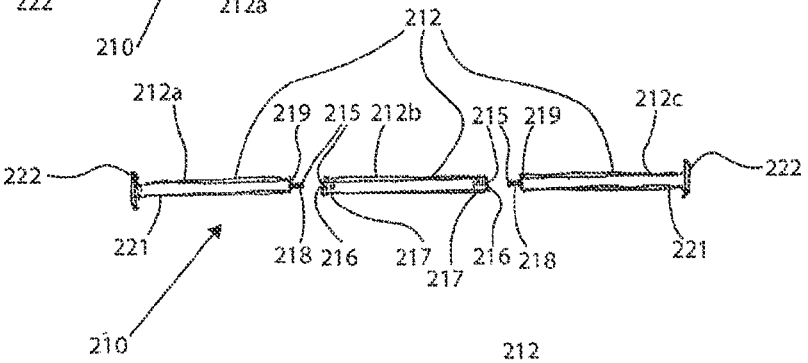
FIG. 17 is a side elevation view of the exemplary rod segments of the module connection mechanism.
Figure 18:
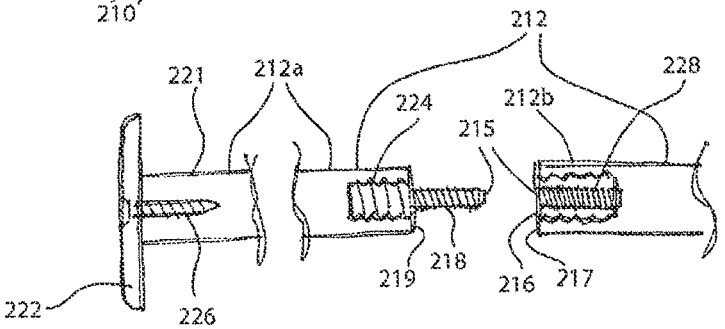
FIG. 18 is an enlarged fragmentary side elevation view of a portion of the exemplary rod segments of the module connection mechanism.

FIGS. 16, 17, and 18 show an exemplary embodiment of an elongated connection mechanism 210 having rod segments 212 including a head rod segment 212*a* for passing through holes in the mattress modules of the head mattress section 22, a center rod segment 212*b* for passing through a hole 214 in the mattress module 26 of the center mattress section 20, and a foot rod segment 212*c* for passing through holes in the mattress modules of the foot mattress section 24. In some embodiments, the modular mattress system 10 employs two elongated connection mechanisms 210 close to the edges of each side of the modular mattress system 10. However, one or more additional elongated connection mechanisms 210 could be employed such as in a central position. The elongated connection mechanisms 210 can be made of any type of rigid material, such as metal, plastic, or wood. Each exemplary elongated connection mechanism 210 can be divisible into multiple separate segments 212, such as into three segments, for shipping purposes. However, a fewer number or a greater number of segments 212 can be used.

The rod segments 212 are reversibly attachable to each other by mated connectors 215. In some embodiments, the mated connectors 215 include mated bolts 218 and threaded receptacles 216. For example, the center rod segment 212*b* can include threaded receptacles 216 on each end 217 that are adapted to receive bolts 218 extending from internal ends 219 of the head rod segment 212*a* and the foot rod segment 212*c*. However, the center rod segment 212*b* could instead include the bolts 218, and the head rod segment 212*a* and the foot rod segment 212*c* could include the threaded receptacles 216. Moreover, other types of mated connectors 215 for the rod segments 212 could be employed.

The assembled elongated connection mechanism 210 has a length that is about the length 110 of the assembled modular mattress system 10 or slightly shorter, or the length of the elongated connection mechanism 210 or the tightness of the mated connectors 115 (e.g., threaded connectors) can be adjusted to customize the tightness of the gaps 70. A looser condition allows an arm to slide in between the mattress modules more easily, and a tighter condition makes the modular mattress system 10 more rigid and solid but makes sliding an arm in between the mattress modules more difficult. Flanges 222 at the ends of the head rod segment 212*a* and the foot rod segment 212*c* prevent slippage of the external ends 221 of the assembled elongated connection mechanisms 210 through the mattress modules and helps to keep them at a desired tightness condition.

In one embodiment shown in FIG. 18, the elongated connection mechanism 210 employs wood rod segments 212. In this embodiment, the head rod segment 212*a* includes an insert metal bolt head 224 that provides the metal bolt 218 that sticks out of the internal end 219 of the head rod segment 212*a*. The head rod segment 212*a* also includes a wooden flange head 222 bonded to the head rod segment 212*a* with glue and a screw 226. The center rod segment 212*b* includes metal insert nuts 228 at its ends, wherein each metal insert nut 228 is adapted to receive the metal bolt 218 of the head rod segment 212*a*.

Figure 19:
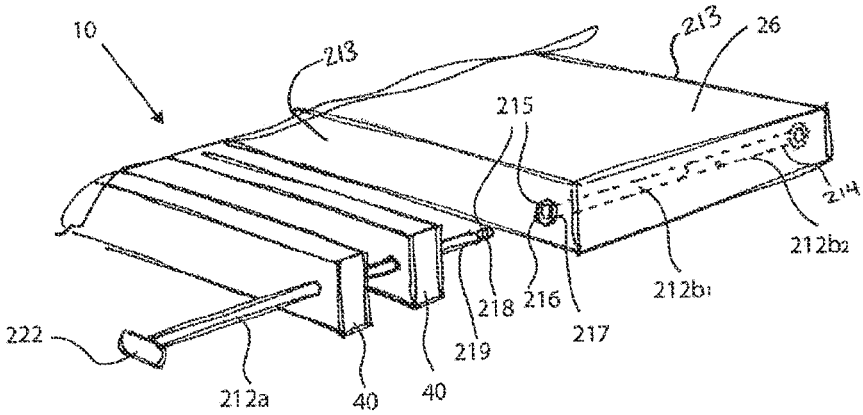
FIG. 19 is a fragmentary exploded perspective view of alternative rod segments of the module connection mechanism of the modular mattress system.
Figure 20:
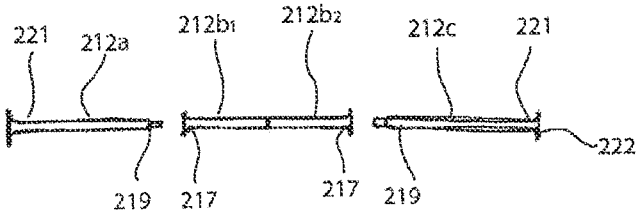
FIG. 20 is a side elevation view of the alternative rod segments of the module connection mechanism.
Figure 21:
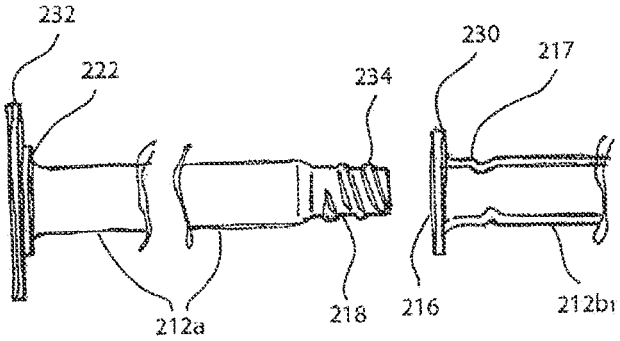
FIG. 21 is an enlarged fragmentary side elevation view of a portion of the alternative rod segments of the module connection mechanism.

FIGS. 19, 20, and 21 show another exemplary embodiment of a metal elongated connection mechanism 210 that is similar in many respects to the elongated connection mechanism 210 shown in FIGS. 16 and 17. One main difference is that the center rod segment 212*b* is divided into two center rod segments 212$b_1$ and 212$b_2$ so that the metal elongated connection mechanism 210 can be shipped in four discrete pieces. The embodiment employing the two center rod segments 212$b_1$ and 212$b_2$ also permits them to be inserted from both ends 213 of the large-sized mattress module 26 and connected to each other within the hole 214. The two center rod segments 212$b_1$ and 212$b_2$ connect to each other inside the mattress module 26. They may each have a little flanged head 230 on external ends 217, which are respectively adapted to mate with the head rod segment 212*a* and the foot rod segment 212*c*. An exemplary mating mechanism may include a male/female screw or quarter-turn connection. A larger sheet metal flange head 232 may be spot welded to the flanged head 222 of the head rod segment 212*a*. The little flanged head 230 may be the same as or different from the flanged head 222. The metal elongated connection mechanisms 210 may be solid or tubular.

FIGS. 22, 23, and 24 show another exemplary embodiment of an injection molded plastic elongated connection mechanism 210 that is similar in many respects to the elongated connection mechanism 210 shown in FIGS. 19, 20, and 21. One main difference is that the rod segments 212 have holes 240 for reasons described later. Another difference is that the male threaded mating members 234 can be hollow. These injection molded plastic elongated connection mechanisms 210 can also be divided into multiple modular segments 212 and sized to be a factor of about the unit length. In an exemplary embodiment, some or all of the modular segments 212 have a length 250 that is about the same size as three unit lengths 52 or one length 62 of the medium-sized module 44. In one embodiment, 18 modular segments 212 can be deployed to form a single elongated connection mechanism 210. Some or all of these modular segments 212 will have a male thread 234 on one end and female thread 236 on the other end, wherein each male thread 234 can be screwed into a mated female thread 236 in the flanged head 222 of another modular segment 212. Nine modular segments 212 can be employed to hold together the head mattress section 22 and connect it to the center mattress section 20, and nine modular segments 212 can be employed to hold together the foot mattress section 24 and connect it to the center mattress section 20.

Two of these modular segments 212 can be inserted into the hole 214 (FIG. 16) in the large-sized mattress module 26 in the center mattress section 20 from both ends 260 (FIG. 16) such that the flanged heads 222 abut the ends 260 and such that the ends 219 of the modular segments 212 do not extend to the center of the large-sized mattress module 26. Moreover, the ends 219 of these two centrally positioned modular segments 212 do not reach and connect with each other. The position of these modular segments 212 with respect to ends 260 of the large-sized mattress module 26 can be relatively permanently established by injecting some polyurethane foam or other expansive adhesive through the hollow female threads 236 of the flanged ends 222. A temporary cap (not shown) can then be inserted into the hollow female threads 236 to keep the expanding foam away from the threads. The expanding foam penetrates into the core material layer 140 through the multiple holes 240 in these two modular segments 212. After the expanding foam solidifies, it creates a relatively permanent bond between the modular segments 212 and the core material layer 140 within in the large-sized mattress module 26. One advantage of embodiments of this nature is that each elongated connection mechanism 210 can be made from identical modular segments 212, which reduces manufacturing costs.

FIGS. 25A, 25B, and 25C show alternative end profiles for flanged heads 222. The different flange head profiles 222*a*, 222*b*, and 222*c* offer different looks and different ease of grip.

Figure 26:
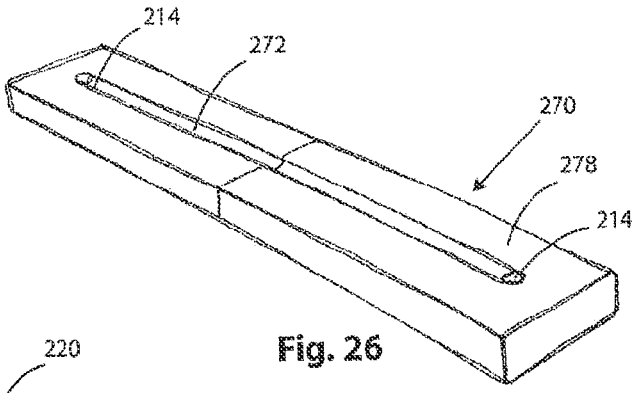
FIG. 26 is a perspective view of an alternative embodiment of an end mattress module lying on its side, showing a groove to accommodate a brace.
Figure 27:
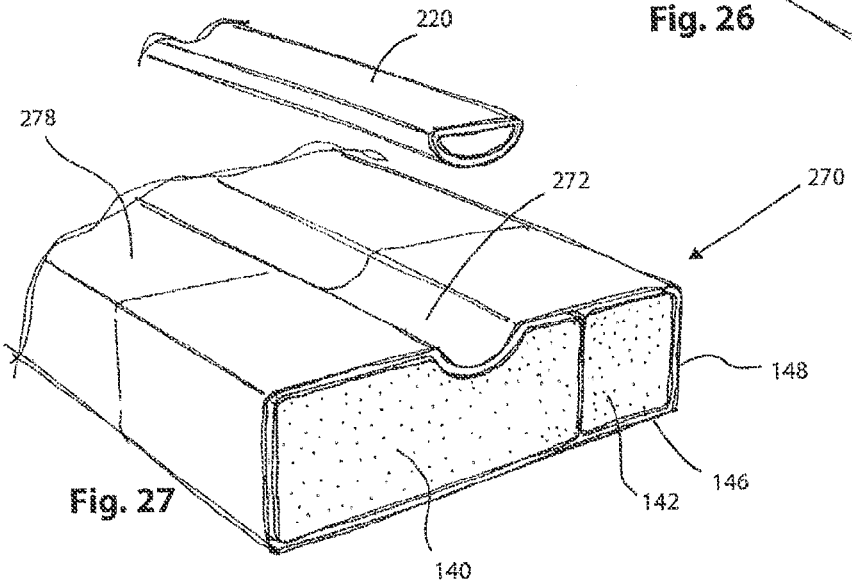
FIG. 27 is an enlarged fragmentary perspective view of a section of an alternative embodiment of a mattress module lying on its side, showing the groove and the brace.
Figure 28:
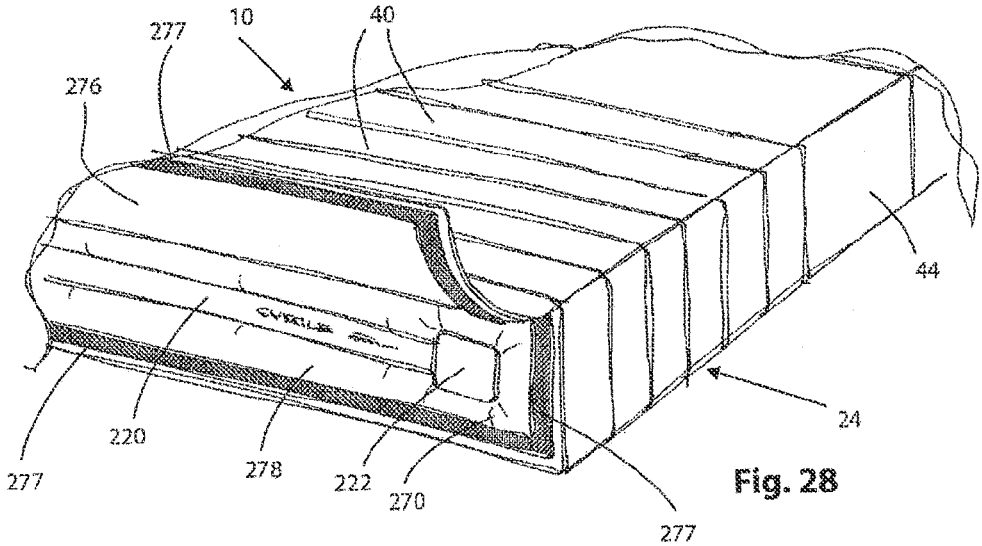
FIG. 28 is a fragmentary perspective view of an embodiment of the modular mattress system, showing a peeled-up flap exposing or covering the shaped brace positioned in the groove.
Figure 29:
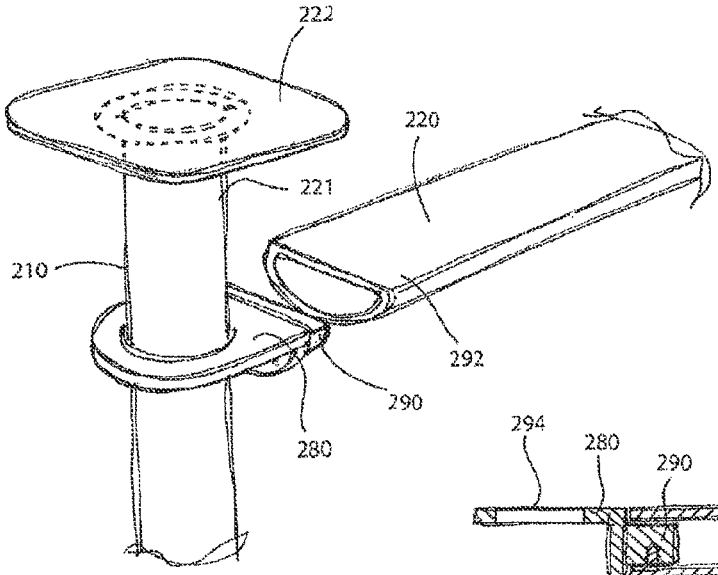
FIG. 29 is a close-up isometric view of a brace bracket for connecting the brace to the rod segment of the module connection mechanism.
Figure 30:
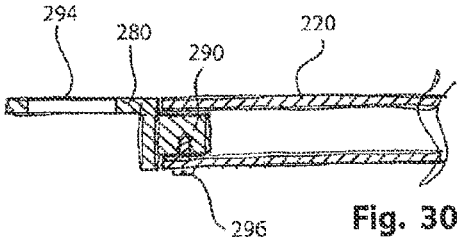
FIG. 30 is a fragmentary cross-sectional view of the brace bracket as connected to the brace and the rod segment of the module connection mechanism.

FIGS. 26, 27, and 28 show an alternative embodiment of a bracing mattress module 270 having a groove 272 adapted to accommodate a brace 220. The bracing mattress module 270 may be any of the small-, medium-, and large-sized mattress modules 44, 40, and 26. Typically, the modular mattress system 10 will include two bracing mattress modules 270 to serve as the ends of the head mattress section 22 and the foot mattress section 24. However, some or all of the small-, medium-, and large-sized mattress modules 44, 40, and 26 may be a bracing mattress module 270 to permit extra stability for the frame 200 or to permit a consumer to select the module size at the end of each of the head mattress section 22 and the foot mattress section 24.

In an exemplary embodiment, the groove 272 is a curved depression that is sized to receive a D-shaped brace 220 and extends in the width direction between the holes 214 that receive the elongated connection mechanism 210. The groove 272 is carved in the core material layer 140 and is covered with the overlays 146 and 148. However, the fabric of the overlays is loose enough to rest into the groove 272 so that the D-shape brace 220 can sit in the groove 272. One will appreciate that the brace 220 can be of any cross-sectional shape, such as circular, square, rectangular, ovoid, diamond, etc., and may be solid or hollow.

The bracing mattress module 270 may have a partly attached flap 276 that is sized to cover the groove 272 or an entire side 278 of the bracing mattress module 270. The flap 276 may be connected to the exterior overlay 148 and is suited to hide the D-shaped brace 220. Velcro™ 277 or other releasable fastener may be deployed along the non-attached edges of the flap 276 with a mated fastening mechanism attached to the side 278 to permit a tight seal.

Figure 31:
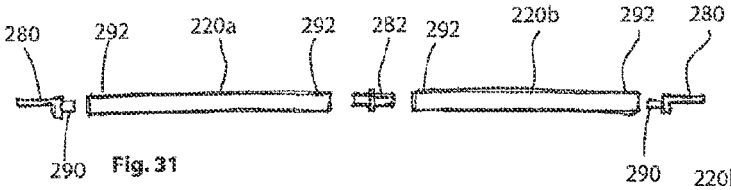
FIG. 31 is a side elevation view of a brace connector for connecting brace segments that form a brace.
Figure 32:
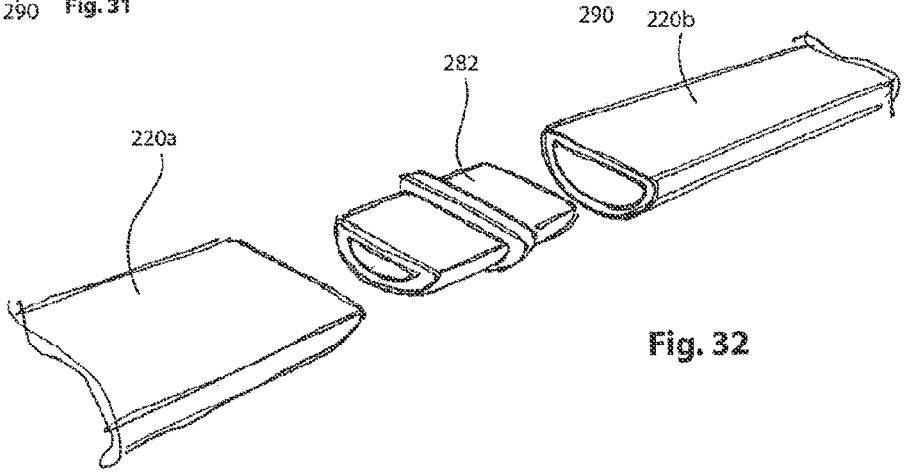
FIG. 32 is a fragmentary perspective view of a brace connector for connecting two brace segments.
Figure 33:
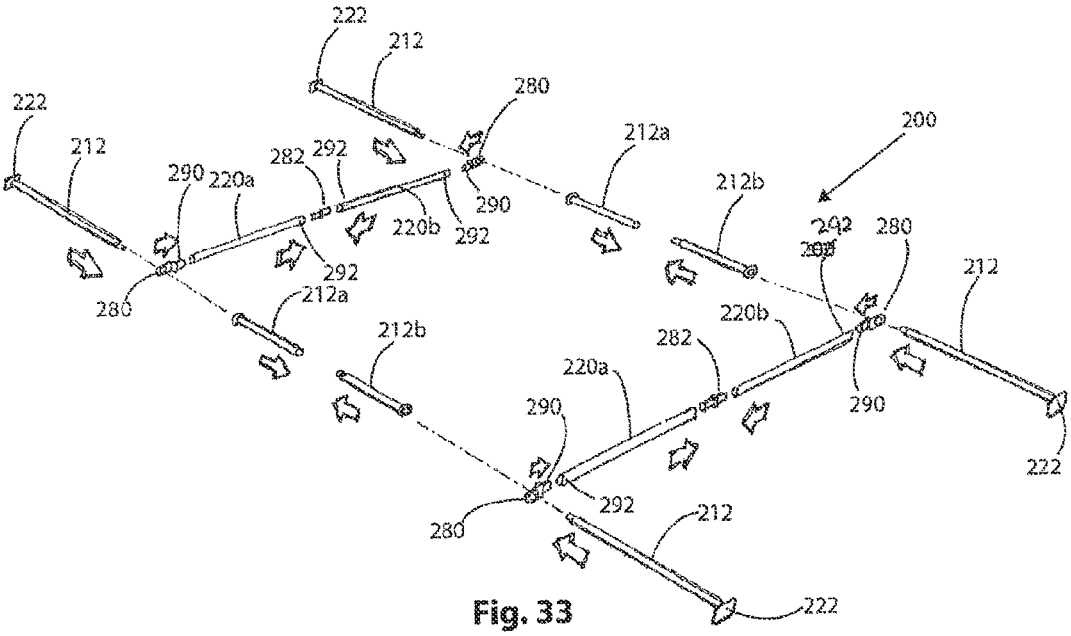
FIG. 33 is an exploded perspective view of a frame composed of rod segments of the module connection mechanism, braces, brace connectors, and brace brackets.
Figure 34:
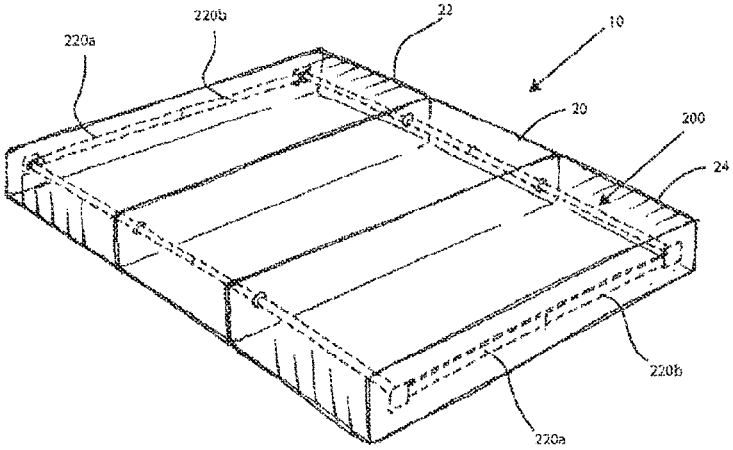
FIG. 34 is a perspective view of the frame as deployed to connect modules of the modular mattress system.

The D-shaped braces 220 may also be divided into two or more brace segments 220*a* and 220*b* (FIG. 31) to facilitate ease of packaging and reduce cost of shipping. The brace segments 220*a* and 220*b* may be connected by a male brace connector 282 adapted for insertion into the ends 292 of the brace segments 220*a* and 220*b* to hold them together and keep them straight. Alternatively, the brace segments 220*a* and 220*b* may be connected by a female brace connector adapted for engulfment of the ends 292 of the brace segments 220*a* and 220*b*.

FIGS. 29, 30, 31, 32, 33, and 34 show an exemplary assembly of the frame 200 with brace brackets 280 for connecting the braces 220 to the elongated connection mechanisms 210. The brace brackets 280 may be in the form of an end cap washer that helps to hold the D-shaped braces 220 within the grooves 272 while interlocking with the ends 221 of the elongated connection mechanisms 210. The end cap washer configuration of the brace brackets 280 provides an extended washer wing 290 adapted for insertion into (or engulfment of) the ends 292 of the braces 220. A screw 296 or other fastening mechanism may be employed to alternatively or additionally secure the brace brackets 280 to the braces 220.

The end cap washer configuration of brace brackets 280 also provides a hole 294 having a diameter that is adapted to receive (and in some embodiments, snuggly hold) the elongated connection mechanisms 210. For example, the diameter of the hole 294 may be about the same size as the diameter of a rod segment. An elongated connection mechanism 210 passes through the washer hole 294 of the brace bracket 280 and then passes through the mattress modules. The brace brackets 280 interlock the braces 220 with the elongated connection mechanisms 210 to make a strong frame 200 all around the modular mattress system 10.

The frame 200 provides the modular mattress system 200 with a rectangular rigid structure that not only keeps the mattress modules in place, but also provides the bracing mattress module 270 at the ends of the head mattress section 22 and the foot mattress section 24 with a proper rigidity to maintain desired pressure between the mattress modules. Maintaining desired pressure between the mattress modules provides sufficient room in gaps 70 in between the mattress modules to put arms, shoulders, and/or feet into the gaps 70, while providing a firm structure sufficiently stable enough to hold the body weight of one or more people during typical mattress-supportive activities, including but not limited to sleeping, cuddling, snuggling, and spooning.

FIGS. 35A and 35B show a pair of hands of a person holding a piece of stretchable sheet fabric 300 in respectively an unstretched condition and in an exemplary stretched condition. FIGS. 36, 37, 38, 39, 40, and 41 demonstrate the stretchability of a fitted sheet 302 made from the stretchable sheet fabric 300. The stretchable fitted sheet 302 is sized to cover the head, center, and foot sections 22, 20, and 24 of the modular mattress system 10 as would a standard sheet made of standard sheet fabric. In some embodiments, the stretchable fitted sheet 302 comprises a stretch cotton fabric; however, it can comprise any type of stretch fabric that can be stretched undamaged to accommodate a shoulder into in a gap 70 and then return to its original length when it assumes an unstretched configuration.

In some embodiments, the stretchable fitted sheet 302 can be stretched undamaged to accommodate at least an arm and a shoulder in a gap 70 and then return to its original length. In some embodiments, the stretchable fitted sheet 302 can be stretched undamaged to accommodate at least two sets of arms and shoulders in the same gap 70 and then return to its original length. In some embodiments, the stretchable fitted sheet 302 can be stretched undamaged to accommodate at least two sets of arms and shoulders in separate gaps 70 and then return to its original length. In some embodiments, the stretchable fitted sheet 302 can be stretched undamaged to accommodate at least a foot and two sets of arms and shoulders in separate gaps 70 and then return to its original length. In some embodiments, the stretchable fitted sheet 302 can be stretched undamaged to accommodate at least two feet and two sets of arms and shoulders in separate gaps 70 and then return to its original length.

In some embodiments, the stretchable fitted sheet 302 may include multiple sections of different materials. For convenience, these sections may be head, center, and foot sections 304, 306, and 308, but the stretchable fitted sheet 302 may include more or fewer sections, and the sections may have correlation with the head, center, and foot mattress sections 22, 20, and 24. In an exemplary embodiment, the center section 306 may be made from a material that is less stretchable than the head and foot sections 304 and 308. In some embodiments, the center section 308 or other section may include a water proof or water resistant material. The sheet sections may be sewn together or attached in other known manners. In some embodiments, the stretchable fitted sheet 302 is adapted to cover only the body contact surface of the modular mattress system 10 and may include one or more rubber (or other material) webbing pieces 312 in its corners and stretch lace 314 around its perimeter to hold the stretchable fitted sheet 302 in place over the modular mattress system 10. However, the stretchable fitted sheet 302 may be adapted to encase the entire the modular mattress system 10. Alternatively, the stretchable fitted sheet 302 may be sized to individually cover head and foot sections 22 and 24.

Figure 39:
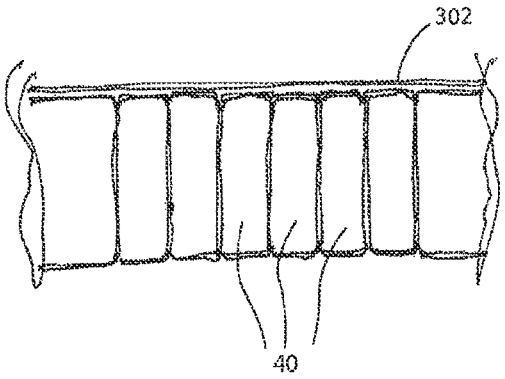
FIG. 39 is a fragmentary side elevation view of a head or foot mattress section with a stretchable sheet deployed in a relatively unstretched condition.
Figure 40:
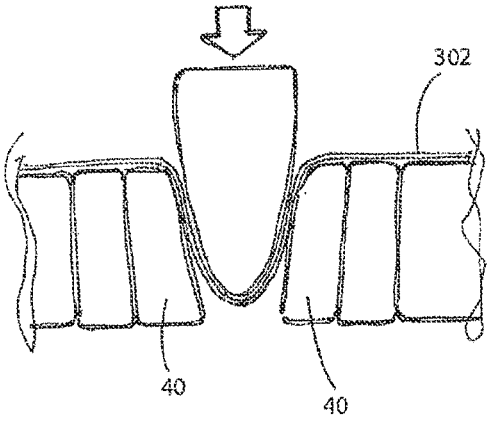
FIG. 40 is a fragmentary side elevation view of a head or foot mattress section with a stretchable sheet in a stretched condition between modules in response to an applied downward stretching force.
Figure 41:
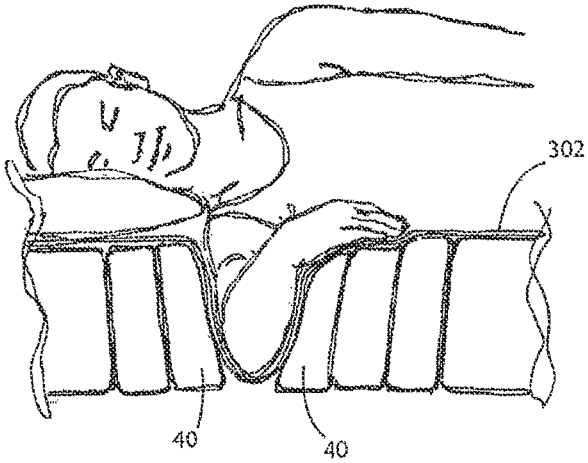
FIG. 41 is a fragmentary side elevation view of a head mattress section with a stretchable sheet in a stretched conditioned between modules in response to an applied downward stretching force of an arm and shoulder of a person lying on his side.

FIG. 39 is a fragmentary side elevation view of a head or foot mattress section 22 or 24 with the stretchable fitted sheet 302 deployed in a relatively unstretched conditioned, and FIG. 40 is a fragmentary side elevation view of a head or foot mattress section 22 or 24 with the stretchable fitted sheet 302 in a stretched conditioned between the mattress modules 40 in response to an applied downward stretching force. FIG. 41 is a fragmentary side elevation view of a head mattress section 22 with the stretchable fitted sheet 302 in a stretched conditioned between the mattress modules 40 in response to an applied downward stretching force of the right arm of a person lying on his right side.

In some embodiments, the stretchable fitted sheet 302 or a sheet section thereof covers module body contact surface areas of multiple mattress modules when the mattress modules are connected, wherein the stretchable fitted sheet 302 is sufficiently stretchable to extend into the gap 70 between the connected mattress modules while still covering the body contact surface areas of the multiple mattress modules. In some embodiments, the stretchable fitted sheet 302 has sufficient stretchability to extend into a gap 70 at least one-third of the module depth 114 in between the connected mattress modules while still covering the body contact surface areas of the multiple mattress modules. In some embodiments, the stretchable fitted sheet 302 has sufficient stretchability to extend into a gap 70 at least the module depth 114 in between the connected mattress modules while still covering the body contact surface areas of the multiple mattress modules. In some embodiments, the stretchable fitted sheet 302 has sufficient stretchability to extend cumulatively at least three times the module depth 114 between sets of the connected mattress modules while still covering the body contact surface areas of the multiple mattress modules.

Figure 42:
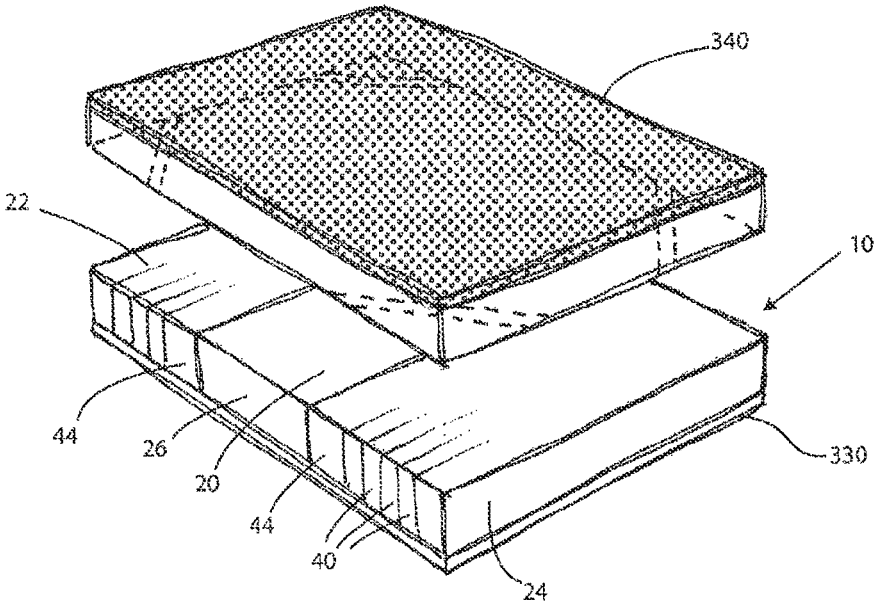
FIG. 42 is an exploded perspective view of an embodiment of the mattress modular system, showing an embodiment of a topper mat for covering the mattress modules.

FIG. 42 shows an embodiment of a topper mat 340 for covering the mattress modules. An exemplary topper mat 340 includes a foam layer upholstered with any type of conventional bedding material and may serve like a mattress pillow layer. The topper layer 340 can be fitted or unfitted and attached by webbing, stretch lace, Velcro™, or other conventional fastening method. The topper mat 340 can be used to provide a more uniform body contact surface at times when the use of the gaps 70 is not intended. For example, the topper mat 340 can be positioned by on top of the mattress modules by a hotel maid so that the mattress module system 10 can be transformed to have the look and feel of a conventional mattress 100.

Figure 43:
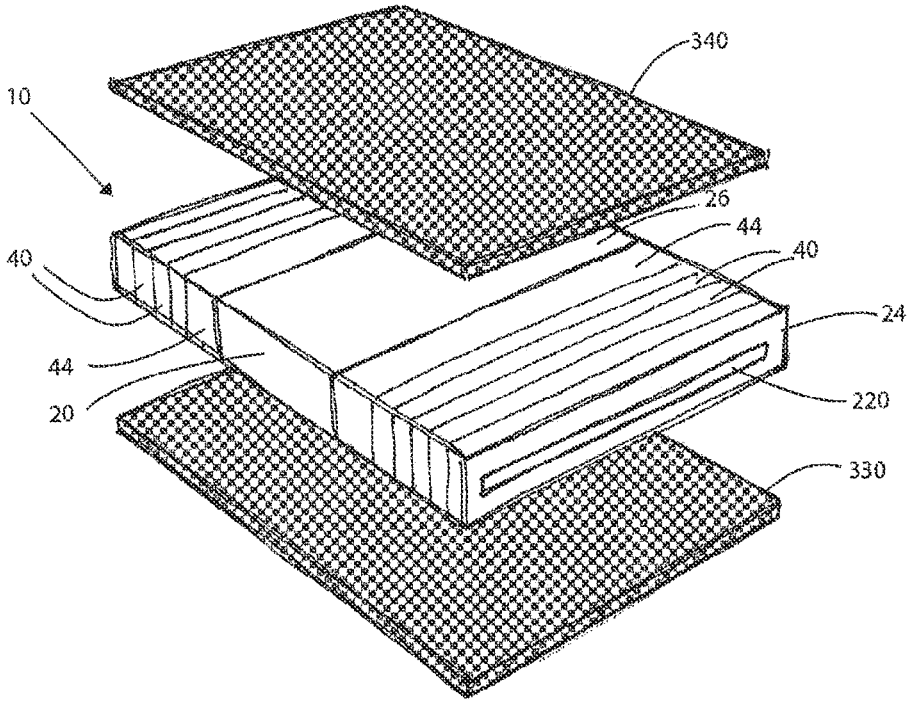
FIG. 43 is an exploded perspective view of an embodiment of the mattress modular system supported by the bottom support layer and covered by the topper mat.
Figure 44:
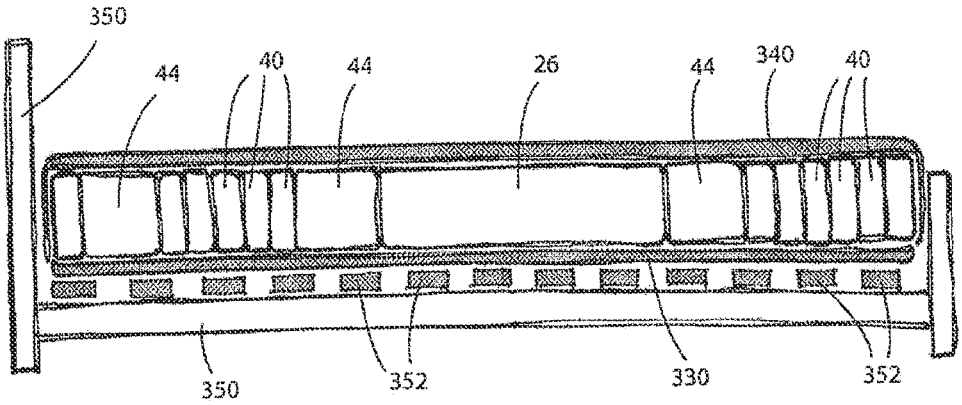
FIG. 44 is a side elevation view of an embodiment of the mattress modular system supported by the bottom support mat and a bed frame having bed slats.

FIG. 43 shows an embodiment of the mattress modular system 10 supported by the bottom support mat 330 and covered by the topper mat 340. The bottom support mat 330 can be employed to prevent a person's arm or other appendages from sliding completely through the gaps 70 and contacting things that are below the mattress modules such as box springs, bed frame, or flooring. Moreover, the bottom support mat 330 can prevent hazards posed by unexpected activities, such as a dog jumping of the modular mattress system 10 and putting some of its feet all the way through the slats. FIG. 44 shows an embodiment of the mattress modular system 10 supported by the bottom support mat 330 and a bed frame 350 having bed slats 352. The bottom support mat 330 can be employed to prevent mattress modules from slipping down between spaced-apart bed slats 352 of the bed frame 350.

It will be obvious to those having skill in the art that many changes may be made to the details of the above-described embodiments without departing from the underlying principles of the invention. For example, skilled persons will appreciate that subject matter of any sentence or paragraph can be combined with subject matter of some or all of the other sentences or paragraphs, except where such combinations are mutually exclusive. The scope of the present invention should, therefore, be determined only by the following claims.

The invention claimed is:

1. A modular mattress system formed by arrangement of multiple mattress sections that, when assembled, provide a body contact surface defined by multiple sectional body contact surface areas, comprising:

a center mattress section configured for positioning between a head mattress section and a foot mattress section, the center mattress section having an interior, a width, and a central body contact surface area;

each of the head and foot mattress sections including multiple mattress modules, one of the head and foot mattress sections including mattress modules of different sizes, and each of the multiple mattress modules having an interior, a width, and a module body contact surface area that is smaller than the central body contact surface area of the center mattress section; and multiple elongated rigid connection mechanisms sized to assemble the modular mattress system by extending in spaced apart relationship through the interiors of, and in directions transverse to the widths of, the head, center, and foot mattress sections, the elongated rigid connection mechanisms configured to establish, in the assembled mattress system, gaps between adjacent ones of the multiple mattress modules and between the center mattress section and each of the head and foot mattress sections, the gaps established in the head mattress section including gaps positioned in arm locations to receive a shoulder or an arm, and the gaps established in the foot mattress section including gaps positioned at foot locations to receive a foot, of a person lying on the body contact surface of the modular mattress system.

2. The modular mattress system of claim 1, wherein one of the head, foot, and center mattress sections includes a mattress module having a core layer and one or more softer layers, and wherein the core layer is firmer than the one or more softer layers.

3. The modular mattress system of claim 2, wherein the one or more softer layers and the core layer include a different one of a breathable foam, gel, gel-foam, or an adjustable air cushion.

4. The modular mattress system of claim 1, wherein each of the multiple mattress sections includes a mattress module having a core layer and one or more softer layers, and wherein the core layer is firmer than the one or more softer layers.

5. The modular mattress system of claim 4, wherein the core layers of two of the mattress modules are made of different materials.

6. The modular mattress system of claim 4, wherein the softer layers of two of the mattress modules are made of different materials.

7. The modular mattress system of claim 1, wherein each of the head and foot mattress sections includes multiple mattress modules, each having a firmer body contact surface area and a softer body contact surface area.

8. The modular mattress system of claim 1, wherein one of the head and foot mattress sections includes multiple mattress modules, including first and second mattress modules, wherein each of the first and second mattress modules has a firmer body contact surface area and a softer body contact surface area, wherein the elongated connection mechanisms permit the first and second mattress modules to be connected in multiple alternative surface configurations with respect to each other, including first and second surface configurations, wherein the softer body contact surface area of the first mattress module is adjacent to the softer body contact surface area of the second mattress module in the first surface configuration, and wherein the softer body contact surface area of the first mattress module is adjacent to the firmer body contact surface area of the second mattress module in the second surface configuration.

9. The modular mattress system of claim 1, wherein one of the head, center, and foot mattress sections includes a mattress module comprising one of a breathable foam, gel, gel-foam, or an adjustable air cushion.

10. The modular mattress system of claim 1, wherein each of the head, center, and foot mattress sections includes a mattress module comprising one of a breathable foam, gel, gel-foam, or an adjustable air cushion.

11. The modular mattress system of claim 1, wherein the elongated rigid connection mechanisms form a rigid internal frame or a bendable internal frame.

12. The modular mattress system of claim 1, wherein one of the elongated rigid connection mechanisms includes multiple rod segments.

13. The modular mattress system of claim 1, further comprising a bracket suitable for connecting the elongated rigid connection mechanisms at the head mattress section, foot mattress section, or both.

14. The modular mattress system of claim 1, wherein the mattress modules each have module body contact surface areas, further comprising:

a fitted sheet that has an original length and covers adjacent ones of the module body contact surface areas when the mattress modules are connected, wherein the sheet comprises a stretchable fabric that is sufficiently stretchable to extend depthwise in between the mattress modules when they are connected and when they receive the foot, shoulder, or arm of the person lying on the body contact surface areas and that is sufficiently resilient to return to its original length when the foot, shoulder, or arm is removed from between the mattress modules.

15. The modular mattress system of claim 1, wherein all or a portion of the mattress modules are covered by a removable topper mat to cover one or more of the gaps and thereby unify the mattress modules into a larger section.

16. The modular mattress system of claim 1 having a bottom surface, and further comprising a bottom support mat that is positioned beneath the entire bottom surface of the modular mattress system.

17. A modular mattress system, comprising:

multiple mattress modules, including first and second mattress modules, wherein in each of the mattress modules has an interior and a width, wherein each of the first and second mattress modules includes a core layer and first and second softer layers positioned on either side of the core layer, and wherein the core layer is firmer than the first and second softer layers; and an elongated connection mechanism sized to assemble the modular mattress system by extending in spaced apart relationship through the interiors of, and in directions transverse to the widths of, the first and second mattress modules, wherein the first mattress module is adjacent to the second mattress module, wherein the elongated connection mechanism permits the first and second mattress modules to be connected in multiple alternative body contact surface configurations with respect to each other, including first and second surface configurations, wherein the first softer layer of the first mattress module is adjacent to the first softer layer of the second mattress module in the first body contact surface configuration, and wherein the first softer layer of the first mattress module is adjacent to the second softer layer of the second mattress module in the second body contact surface configuration.

18. The modular mattress system of claim 17, wherein the first and second mattress modules have respective first and second module lengths in a direction transverse to the widths of the mattress modules, and wherein the first and second module lengths are different.

* * * * *